United States Patent [19]

Krause

[11] 4,158,582

[45] Jun. 19, 1979

[54] METHOD OF MAKING PRESSED MAGNETIC CORE COMPONENTS

[75] Inventor: Robert F. Krause, Murrysville, Pa.

[73] Assignee: Westinghouse Electric Corp., Pittsburgh, Pa.

[21] Appl. No.: 896,526

[22] Filed: Apr. 14, 1978

[51] Int. Cl.[2] ..... H01F 1/08

[52] U.S. Cl. ..... 148/120; 148/105; 148/121; 148/122

[58] Field of Search ..... 148/104, 105, 108, 110, 148/111, 112, 113, 120, 121, 122; 29/596, 597, 598; 264/111

[56] References Cited

U.S. PATENT DOCUMENTS

| | | | |
|---|---|---|---|
| 3,848,331 | 11/1974 | Pavlik et al. | 29/596 |
| 3,948,690 | 4/1976 | Pavlik et al. | 148/122 |

*Primary Examiner*—L. Dewayne Rutledge
*Assistant Examiner*—Michael L. Lewis
*Attorney, Agent, or Firm*—L. P. Johns

[57] ABSTRACT

A method of making pressed magnetic core components having a low core loss property for use in electrical apparatus characterized by reannealing and repressing said components after initial annealing and pressing.

7 Claims, 5 Drawing Figures

METHOD OF MAKING PRESSED MAGNETIC CORE COMPONENTS

CROSS-REFERENCE TO RELATED APPLICATIONS

This invention is related to the copending applications Ser. No. 896,534, filed Apr. 14, 1978 by R. F. Krause and N. Pavlik (W.E. Case 47,271); Ser. No. 896,533, filed Apr. 14, 1978, by N. Pavlik and John Sefko (W.E. Case 47,244); Ser. No. 896,525, filed Apr. 14, 1978 (W.E. Case 47,099), by R. F. Krause, N. Pavlik, and K. A. Grunert; Ser. No. 896,535, filed Apr. 14, 1978 by William F. Reynolds and N. Pavlik (W.E. Case 47,262; and Ser. No. 896,536, filed Apr. 14, 1978 by R. F. Krause, N. Pavlik and C. Eaves (W.E. Case 47,231).

BACKGROUND OF THE INVENTION

1. Field of the Invention

This invention relates to a method of making pressed magnetic core components from low carbon steel such as "black-plate" which components exhibit low core loss and higher permeability and more particularly, it pertains to a method for reannealing and repressing low carbon steel microlaminations for use in electrical apparatus.

2. Description of the Prior Art

Microlaminations are substantially flat, elongated, rectangular particles that are formed from plain carbon steel by cutting the same into discretely-shaped particles (elongated parallelopiped of generally rectangular cross-section) following which the microlaminations are decarburized, magnetically insulated, and thereafter placed in a mold and pressed to the desired density without the use of a binder for producing the finished unitary magnetic core. U.S. Pat. Nos. 3,848,331 and 3,948,690 disclose the advantages and methods of applying such electrical insulation.

Although the microlamination concept of producing magnetic devices continuous to show great promise, the largest factors which reduce the applicability of this method of construction are the relatively high core losses and the low permeability at power frequencies. Core losses at 60 Hz are slightly higher than such losses of low carbon steel and the permeability is significantly lower. These factors, although not particularly important in magnetic structures which contain an air gap, can require significant modifications to a device having a completely closed magnetic circuit. For example, a transformer constructed from microlaminations might require an increased core cross-section or additional coil turns in order to achieve characteristics identical to those of a transformer made from punched and stacked laminations. These potential modifications can reduce the inherent economic advantage of the microlamination process.

As a result of the high level of strain in a pressed microlamination compact, greater than 90% of the 60 Hz losses are hysteretic. If this strain could be reduced, without affecting the core insulation, a significant improvement in both the core loss and the permeability could be expected.

Previous work has known that a stress relief anneal does not improve the AC magnetic performance of a pressed compact. In fact, both the core loss and the AC permeability are significantly impaired. Although this area of investigation is incomplete, it appears that the insulation breaks down at points of particle contact.

This results in a significant increase in eddy currents which cause the losses to increase dramatically. Also, the permeability is reduced because of eddy current shielding and reduced flux penetration.

SUMMARY OF THE INVENTION

It has been found in accordance with this invention that both the core loss and the permeability can be improved by a method of making pressed magnetic core components, comprising the steps of annealing ferrous alloy microlaminations in decarburizing and deoxidizing atmosphere to improve the magnetic characteristics by reducing carbon to less than 0.01%, coating the microlaminations with electrically insulating material, assembling the microlaminations within a mold of predetermined configuration, compacting the microlaminations into a magnetizable compact, reannealing the magnetizable compacts to relieve stresses, and recompacting the magnetizable compact to improve the magnetic characteristics.

The advantage of the method of this invention is that microlamination particles, which have been displaced slightly after an initial annealing and pressing, are believed to be restored and thus demonstrate improved magnetic properties in response to a second anneal and subsequent repressing procedure.

DESCRIPTION OF THE PREFERRED EMBODIMENT

Figure 1:
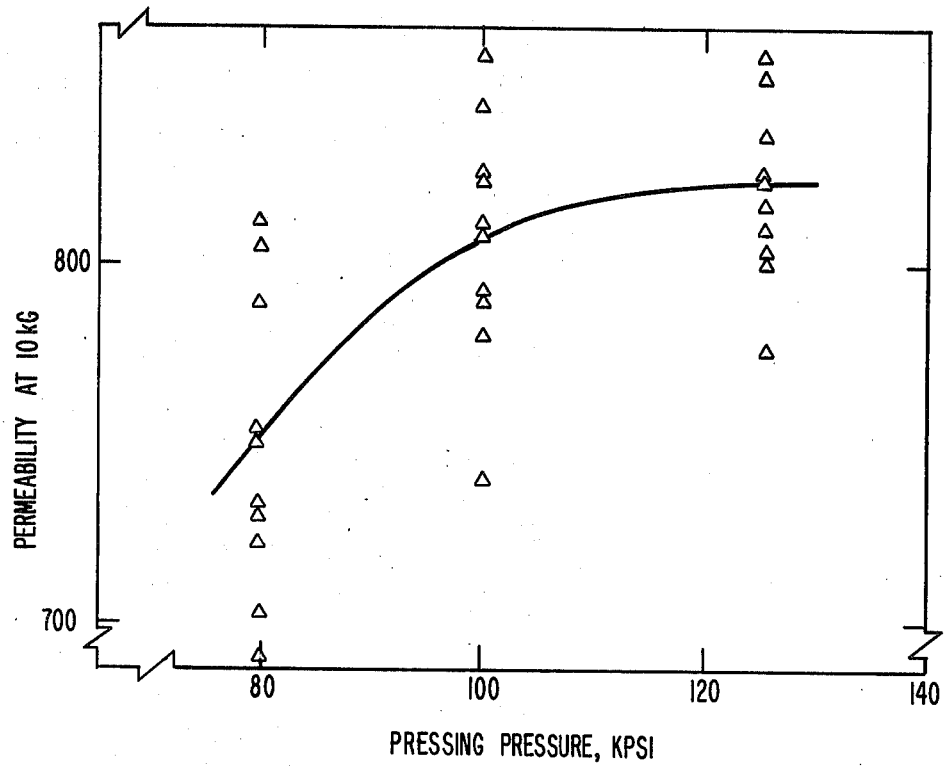
FIG. 1 is a graph showing the effect of initial pressing pressure on permeability of reannealed and repressed size "A" particles.

The method of this invention for making pressed magnetic core components comprises the steps of severing microlaminations from ferrous alloy stock, annealing said microlaminations in decarburizing and deoxidizing atmosphere to improve the magnetic characteristics by reducing carbon to less than 0.01%, coating said microlaminates with electrically insulating material, assembling said microlaminations within a mold of predetermined configuration, compacting said microlaminations into a magnetizable compact, annealing said magnetizable compact to relieve stresses, and repressing said magnetizable compact to improve the magnetic characteristics.

The material from which the microlaminations are made is preferably a plain carbon steel normally of the type used for tin cans. This is a low carbon steel and is recommended because of its low cost and availability. The material is usually purchased in the form of "black plate", that is, the condition of the tin can steel prior to tinning. It is readily available in a wide range of thicknesses usually ranging from about 0.005 to about 0.020 inch in thickness. This black plate tin can stock material is one of the lowest cost ferrous products in this thickness range. Typically the AISI Type 1010 steel will have a composition containing between about 0.07% and about 0.13% carbon, about 0.30% and about 0.60% manganese, about 0.040% maximum phosphorus, about 0.050% maximum sulfur and the balance essentially iron with incidental impurities. Although the preferred material is a plain carbon steel, other magnetic materials as silicon containing steels as well as nickel-iron, molybdenum permalloy, and other intrinsically soft magnetic alloys may be employed.

Moreover, steel with some degree of strength is preferred so that when the microlaminations are formed they do not become grossly distorted as will appear more fully hereinafter. Consequently, a plain carbon steel from about 0.05 to 0.15% carbon is ideally suited, because it has sufficient strength and sufficient ductility to be readily sheared into microlamination sizes. While exceedingly low carbon steels (more properly called "iron") can be employed, they are not recommended because of the tendency to distort during the microlamination formation operation. The plain carbon steel or other magnetic alloy is usually purchased in the cold rolled condition, the plain carbon steel preferably has a gain size of the order of ASTM No. 9. By employing the various magnetic materials in their cold worked condition, from which the microlamination are severed, the resulting product, namely, the microlamination, is in the form of a thin, elongated parallelopiped of substantially rectangular cross-section. The cold-worked condition of the flat worked sheet material thus facilitates the formation and the retention of the as-severed shape. Furthermore, the cold-worked condition with its consequent higher strength and lowered ductility fosters a cleaner edge (less burring) during the severing operation so that then the microlaminations are molded into the finished configuration, the tendency to pierce the insulation is considerably reduced.

It should be noted that while a wide range of steel particle sizes and thicknesses are satisfactory, it is preferred to control the microlaminations to the form of a thin elongated parallelopiped of rectangular cross-section having dimensions between about 0.05 and about 0.20 inch in length, about 0.005 and about 0.05 inch in width, and from about 0.002 to about 0.02 inch in thickness. Within this broad range, particularly satisfactory results have been obtained where the individual microlamination particle length ranges from about 0.050 to about 0.150 inch, from about 0.010 to about 0.030 inch in width, and between about 0.006 and about 0.013 inch in thickness. The microlaminations are usually formed from the tin can stock to the foregoing dimensions by cutting with a high speed rotary die cutter as set forth in U.S. Pat. No. 3,848,331.

The second step of annealing the microlaminations has the primary purpose of decarburizing the microlamination particles. Decarburization occurs within a temperature range of from about 1325° F. to about 1650° F. The time involved varies from about 10 minutes to 2 hours and is dependent upon the size of the particles and the temperature. Normally a deoxidizing atmosphere is sufficient. Nowever, specialized atmospheres, such as wet hydrogen having a dew point in excess of about +60° F., is utilized to decarburize. Thereafter, a dry atmosphere having a dew point of less than about −40° C. to provide a protective atmosphere during cooling of the microlaminations to room temperature.

The third comprises coating of the microlaminations with an electrically insulating material. The microlaminations are insulated from each other to provide the required core loss characteristics within the finished core. Magnesium methylate is a preferred insulating coating material, because the resulting coating is very thin and is sufficiently flexible to withstand the molding pressures. Though other insulating materials may be employed, this coating provides sufficient interlaminar resistance to maintain the required core loss as well as other magnetic characteristics.

The fourth step involves pressing or compaction of the microlamination particles into the desired core configuration. Pressing may occur either uniaxially or isostatically, as disclosed in U.S. Pat. Nos. 3,948,690 and 3,848,331, respectively, and incorporated as part hereof. Workable pressures of from 50,000 to 125,000 psi have been used with the preferred pressure being 120,000 psi. The higher the pressure the better the magnetic characteristics of the resulting compact.

The fifth step of the method involves an anneal subsequent to the compression step. The annealing temperature varies from about 1300° F. to 1800° F. and preferably at 1475° F. for a time period of from 5 to 10 minutes to about one hour. It has been found that the higher the annealing temperature, the better the resulting magnetic properties for the compact.

The sixth and final step involves repressing or recompaction which may be performed either uniaxially or isostatically. The pressures of repressing range from about 50,000 to 125,000 psi.

The crux of this invention comprises the fifth and sixth steps, namely, reannealing and repressing, of the previously compacted and annealed microlaminations. After processing according to the present invention, the magnetic properties including both permeability and core loss are significantly improved at all levels of induction as indicated in the several figures of the drawings.

The following examples is illustrative of the present invention:

EXAMPLE

Materials

Two low carbon steel microlamination sizes, 0.060×0.010×0.006 inch (Size A) and 0.080×0.006 inch (Size B), were processed. Both materials were decarburized to less than 0.005% carbon in a wet hydrogen atmosphere (dew point 28° C.) at a temperature of 750° C. for approximately 30 minutes and were then coated with magnesium methylate. The material was then split and two series of experiments conducted.

Isostatic Repressing

Both microlamination materials were blended with 1/16% stearic acid lubricant and pressed into magnetic test ring cores at pressures of 80 and 125 kpsi. A total of 12 rings were pressed, three at each pressure from each microlamination size. The rings are then annealed at 802° C. in a dry hydrogen atmosphere for times at temperature of 15, 30, and 60 minutes. All samples were inserted directly into the hot zone of the furnace and pulled into the cooling chamber at the completion of the hold time. Time at temperature was determined with a thermocouple attached to the sample.

After annealing, the rings were placed in thin latex bags and cold isostatically repressed at a pressure of 100 kpsi. The cores were wound and the 60 Hz AC and DC magnetic characteristics determined.

Uniaxial Repressing

Both size materials were blended with 1/32% stearic acid and pressed into ring cores at pressures of 80, 100, and 125 kpsi. A total of 60 cores were pressed, 10 at each pressure from each microlamination size. However, the 10 cores pressed from the Size B material at 80 kpsi were discarded. After pressing, one core of each condition was annealed in a dry hydrogen atmosphere at the temperatures at times given below:

| Temperature | Minutes |
|---|---|
| 774° C. | 5 15 30 60 |
| 802° C. | 5 15 30 60 |
| 830° C. | 5 15 |

After annealing, the cores were uniaxially repressed at 125 kpsi. Because a pressed part expands on extraction from a die, a second ring die, slightly larger than the primary pressing die, was constructed for this repressing stage.

The 30 and 60 Hz AC and the DC magnetic characteristics were measured on all samples.

Isostatic Repressing Results

A condensed summary of the results of magnetic tests made on the isostatically repressed cores is shown in Table I. Permeabilities better than those of unannealed cores were obtained on all specimens, independent of the microlamination size. This improvement is due to both the increase in compact density and to the reduction of residual stresses.

TABLE I

Magnetic Characteristics of Annealed Rings Isostatically Repressed at 100 kpsi

| Initial Pressing Pressure (Kpsi) | Time At 802 C (Min.) | Packing Factor (%)* | $B_r$++ (kG) | $H_c$++ (Oe) | At 4 kG | | At 6 kG | | At 8 kG | | At 10 kG | | At 12 kG | | At 14 kG | | At 15 kG | | At 16 kG | |
|---|---|---|---|---|---|---|---|---|---|---|---|---|---|---|---|---|---|---|---|---|
| | | | | | μ | $P_c$ (W/lb) | μ | $P_c$ (W/lb) | μ | $P_c$ (W/lb) | μ | $P_c$ (W/lb) | μ | $P_c$ (W/lb) | μ | $P_c$ (W/lb) | μ | $P_c$ (W/lb) | μ | $P_c$ (W/lb) |
| | | | | | | | | Size "A" Microlaminations | | | | | | | | | | | | |
| 80,000 | 0+ | 92.0 | 4.10 | 4.15 | 511 | 1.09 | 499 | 2.08 | 431 | 3.23 | 339 | 4.54 | 228 | 5.82 | 136 | 6.89 | N.A. | N.A. | N.A. | N.A. |
| | 15 | 98.6 | 5.00 | 2.38 | 932 | 0.91 | 954 | 1.92 | 893 | 3.53 | 787 | 5.20 | 645 | 7.51 | 456 | 10.32 | 350 | 11.90 | 251 | 13.70 |
| | 30 | 99.2 | 4.95 | 2.39 | 996 | 0.78 | 1027 | 1.63 | 963 | 2.78 | 842 | 4.23 | 679 | 6.01 | 478 | 8.12 | 368 | 9.33 | 266 | 10.65 |
| | 60 | 98.9 | 4.80 | 2.30 | 963 | 0.85 | 983 | 1.80 | 918 | 3.10 | 806 | 4.76 | 653 | 6.82 | 464 | 9.29 | 358 | 10.14 | 260 | 11.73 |
| 125,000 | 0+ | 96.8 | 5.05 | 4.19 | 613 | 0.95 | 635 | 1.81 | 583 | 2.84 | 488 | 4.05 | 380 | 5.32 | 250 | 6.57 | 194 | 7.23 | N.A. | N.A. |
| | 15 | 99.0 | 5.70 | 1.99 | 1214 | 0.71 | 1275 | 1.51 | 1234 | 2.61 | 1108 | 4.02 | 903 | 5.73 | 627 | 7.82 | 470 | 9.01 | 327 | 10.31 |
| | 30 | 99.1 | 5.35 | 2.03 | 1079 | 0.83 | 1105 | 1.81 | 1045 | 3.22 | 922 | 5.12 | 756 | 7.65 | 522 | 10.93 | 428 | 12.80 | 299 | 15.04 |
| | 60 | 99.4 | 5.70 | 1.94 | 1142 | 0.84 | 1180 | 1.83 | 1142 | 3.24 | 1034 | 5.10 | 859 | 7.43 | 617 | 10.35 | 469 | 12.05 | 326 | 13.87 |
| | | | | | | | | Size "B" Microlaminations | | | | | | | | | | | | |
| 80,000 | 0+ | 93.0 | 3.50 | 3.09 | 591 | 0.84 | 583 | 1.58 | 518 | 2.46 | 416 | 3.52 | 299 | 4.55 | 187 | 5.61 | N.A. | N.A. | N.A. | N.A. |
| | 15 | 97.1 | 4.20 | 2.16 | 996 | 0.54 | 993 | 1.04 | 902 | 1.66 | 762 | 2.40 | 590 | 3.24 | 391 | 4.20 | 292 | 4.71 | 209 | 5.20 |
| | 30 | 98.0 | 4.25 | 2.08 | 1050 | 0.52 | 1065 | 1.00 | 979 | 1.61 | 839 | 2.32 | 665 | 3.14 | 459 | 4.08 | 350 | 4.60 | 253 | 5.12 |
| | 60** | 94.5 | 1.80 | 1.25 | 896 | 0.38 | 817 | .75 | 673 | 1.22 | 513 | 1.78 | 356 | 2.46 | 220 | 3.17 | 165 | 3.54 | N.A. | N.A. |
| 125,000 | 0+ | 97.6 | 4.30 | 3.09 | 706 | 0.75 | 737 | 1.40 | 675 | 2.21 | 580 | 3.13 | 460 | 4.16 | 314 | 5.26 | 240 | 5.78 | N.A. | N.A. |
| | 15 | 98.7 | 5.00 | 1.80 | 1371 | 0.42 | 1443 | 0.82 | 1348 | 1.32 | 1169 | 1.92 | 922 | 2.63 | 619 | 3.46 | 455 | 3.91 | 311 | 4.36 |
| | 30 | 98.9 | 4.80 | 1.82 | 1309 | 0.44 | 1365 | 0.86 | 1280 | 1.40 | 1112 | 2.04 | 885 | 2.80 | 604 | 3.70 | 453 | 4.19 | 314 | 4.69 |
| | 60 | 99.0 | 4.60 | 1.83 | 1201 | 0.51 | 1239 | 1.04 | 1152 | 1.73 | 998 | 2.62 | 796 | 3.71 | 546 | 5.08 | 411 | 5.91 | 286 | 6.81 |

*Percent of theoretical density.
**Bag broke sometime during isostatic pressing.
+Reference 1 - Cores not annealed or repressed.
++From an applied field of 50 Oe.

The influence of residual stress on the permeability is seen by comparing the cores pressed at 80 kpsi were deformed more on repressing, the residual stress level should be higher and the permeability lower. The coercive force should also be higher. These effects can be observed in Table I.

The effect of packing factor or density on the permeability is very significant and is seen by comparing the "asterisk" sample with any of the annealed and repressed cores (Table I). Since the latex bag apparently broke very early in the repressing cycle, this sample has a much lower compact density than that of all other samples. Although the residual stress level is low indicated by the low value of $H_c$, the permeability is low because of this lower packing factor.

The effect of annealing and repressing on the core loss is significantly different for the two microlamination sizes (Table I). The core loss at 14 kG for the Size "A" particles is poorer than the unannealed standards while the core loss of Size "B" particles is better than the standards at all levels of induction. This effect was also observed in samples uniaxially repressed and is discussed below.

Uniaxial Repressing Results

Figure 2:
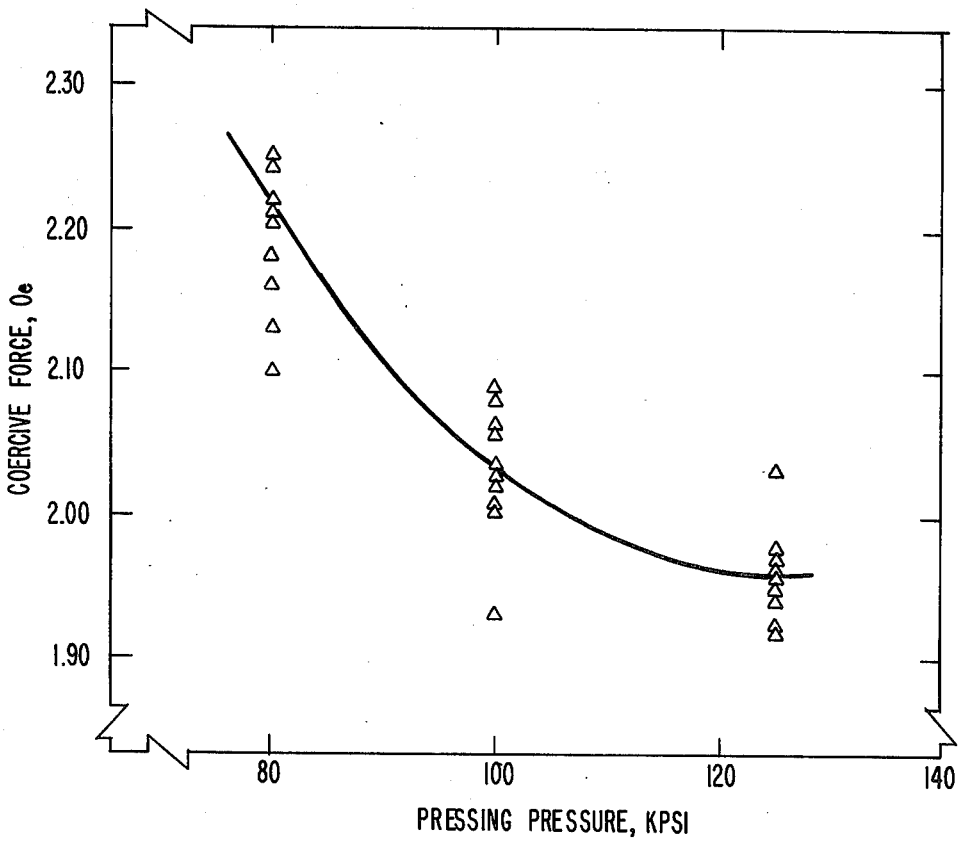
FIG. 2 is a graph showing the effect of initial pressing pressure on coercive force on reannealed and repressed size "A" particles.
Figure 3:
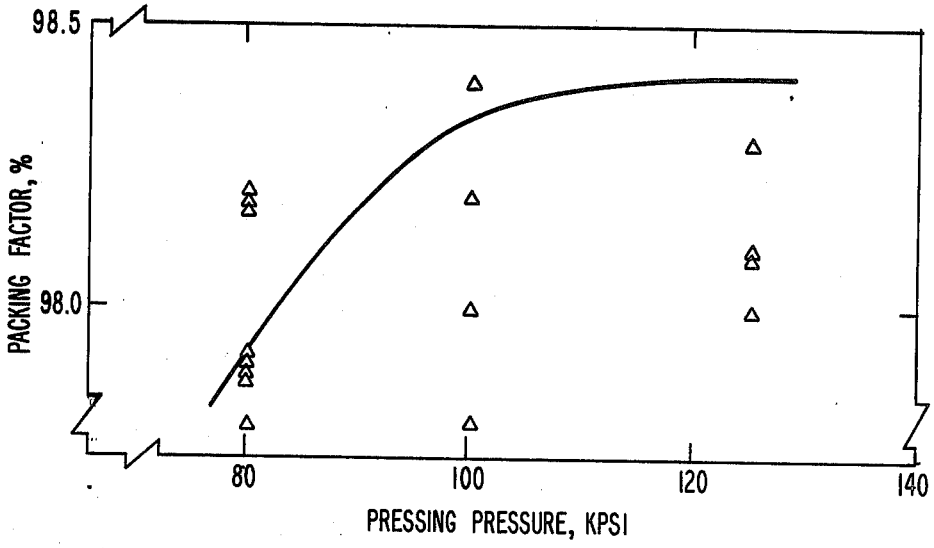
FIG. 3 is a graph showing the effect of initial pressing pressure on packing factor on reannealed and repressed size "A" particles.

Results of magnetic tests of the annealed and uniaxially repressed cores are shown in Table II. Permeabilities are significantly better than those of cores pressed in the conventional manner for both Size "A" and "B" microlaminations. The coercive force values are also lower. The effect of initial pressing pressure on the permeability and coercive force is shown for Size "A" particles in FIGS. 1 and 2, respectively. The improvement in $H_c$ and permeability with increasing initial pressing pressure is due to the increase in the packing factor (FIG. 3).

TABLE II

| Pressing Pressure (Kpsi) | Initial Annealing Temperature (c) | Characteristics of Rings Annealed and Uniaxially Repressed at 125 kpsi — Time At Temperature: 5 Minutes | | | 15 Minutes | | | 30 Minutes | | | 60 Minutes | | |
|---|---|---|---|---|---|---|---|---|---|---|---|---|---|
| | | $H_c$ (Oe) | 10 kG, 60 Hz $\mu$ | 10 kG, 60 Hz $P_c$(w/lb) | $H_c$ (Oe) | At 10 kG, 60 Hz $\mu$ | At 10 kG, 60 Hz $P_c$(W/lb) | $H_c$ (Oe) | At 10 kG, 60 Hz $\mu$ | At 10 kG, 60 Hz $P_c$(W/lb) | $H_c$ (Oe) | At 10kG, 60 Hz $\mu$ | At 10kG, 60 Hz $P_c$(w/lb) |
| | | | | | Size "A" Microlaminations | | | | | | | | |
| 125 | 0+ | 4.19 | 488 | 4.05 | | | | | | | | | |
| 80 | 774 | 2.25 | 731 | 3.95 | 2.13 | 805 | 5.10 | 2.22 | 731 | 4.26 | 2.21 | 750 | 4.46 |
| | 802 | 2.50 | 812 | 4.58 | 2.25 | 703 | 4.13 | 2.21 | 691 | 5.14 | 2.10 | 788 | 5.98 |
| | 830 | 2.16 | 754 | 5.56 | 2.18 | 723 | 5.78 | — | — | — | — | — | — |
| 100 | 774 | 2.03 | 843 | 4.81 | 2.09 | 812 | 5.36 | 2.03 | 858 | 4.96 | 2.01 | 826 | 5.78 |
| | 802 | 2.08 | 740 | 4.17 | 2.06 | 793 | 5.41 | 2.03 | 824 | 5.82 | 2.01 | 780 | 6.61 |
| | 830 | 1.93 | 808 | 5.42 | 2.06 | 790 | 4.36 | — | — | — | — | — | — |
| 125 | 774 | 1.95 | 826 | 4.85 | 1.97 | 858 | 5.52 | 2.03 | 810 | 6.12 | 1.92 | 836 | 5.35 |
| | 802 | 1.97 | 852 | 5.05 | 1.95 | 801 | 4.96 | 1.94 | 817 | 5.06 | 1.92 | 776 | 7.16 |
| | 830 | 1.95 | 805 | 5.83 | 1.97 | 824 | 5.77 | — | — | — | — | — | — |
| | | | | | Size "B" Microlaminations | | | | | | | | |
| 125 | 0+ | 3.09 | 580 | 3.13 | | | | | | | | | |
| 100 | 774 | 1.81 | 744 | 2.24 | 1.83 | 821 | 2.23 | 1.74 | 792 | 2.10 | 1.86 | 778 | 2.16 |
| | 802 | 2.08 | 778 | 2.35 | 1.76 | 742 | 2.19 | 1.82 | 788 | 2.20 | 1.74 | 994 | 2.57 |
| | 830 | 1.74 | 900 | 2.33 | 1.83 | 707 | 2.48 | — | — | — | — | — | — |
| 125 | 774 | 1.75 | 865 | 1.97 | 1.75 | 847 | 2.09 | 1.71 | 831 | 2.08 | 1.67 | 855 | 2.10 |
| | 802 | 1.71 | 818 | 2.06 | 1.70 | 845 | 2.04 | 1.74 | 817 | 2.08 | 1.72 | 981 | 2.57 |
| | 830 | 1.69 | 880 | 2.35 | 1.79 | 911 | 2.02 | — | — | — | — | — | — |

+ *Reference 1 - Cores not annealed or repressed.*

The permeability of the uniaxially repressed cores is poorer than that of compacts repressed isostatically (Tables I and II). This difference is due to the lower packing factor of the uniaxially repressed cores (Table I and FIG. 3). The differences in the stress states between isostatic and uniaxially pressing most likely account for the observed differences in packing factor.

The core loss, Table II, exhibits differences depending on the type of microlamination material. The loss in cores pressed from Size "A" particles is higher than in an unannealed core, while the loss in cores pressed from Size "B" particles is significantly lower than in an unannealed core. Separation of the loss into eddy current and hysteretic components (Table III) shows that while the hysteresis loss is of the same order of magnitude for both particle sizes, there is a dramatic difference in the eddy current component of loss. The eddy current loss is almost an order of magnitude larger for rings pressed from the Size "A" particles.

This difference in the eddy current loss is apparently due to a more severe loss of interparticle insulation on the Size "A" particles. The resistivity of the Size "A" cores is approximately 10 times lower than similar measurements made on the Size "B" cores. More severe burrs (FIG. 4) and the longer amount of edge length per unit volume account for the lower insulation values of the Size "A" cores.

The reduction of hysteresis loss with increasing pressing pressure (Table III) is related to the degree of strain imparted to the compacts on repressing. The lower the initial pressing pressure, the greater the repressing strain and larger the hysteresis loss.

TABLE III

| Microlamination Size | Initial Pressing Pressure (Kpsi) | Average Loss Separation of Rings Uniaxially Repressed at 125 kpsi — Hysteresis Loss, Watts/lb/Cycle × $10^{-2}$: At 6 kG | At 10 kG | At 15 kG | Eddy Current Loss, Watts/lb/Cycle × $10^{-2}$: At 6 kG | At 10 kG | At 15 kG |
|---|---|---|---|---|---|---|---|
| A | 80 | 1.64 | 3.66 | 7.34 | 1.40 | 4.50 | 11.25 |
| | 100 | 1.56 | 3.47 | 6.85 | 1.62 | 5.31 | 13.89 |
| | 125 | 1.55 | 3.40 | 6.77 | 1.75 | 5.83 | 15.39 |
| B | 100 | 1.34 | 3.05 | 5.99 | 0.28 | 0.76 | 1.78 |

TABLE III-continued

| Microlamination Size | Initial Pressing Pressure (Kpsi) | Average Loss Separation of Rings Uniaxially Repressed at 125 kpsi: Hysteresis Loss, Watts/lb/Cycle × $10^{-2}$ At 6 kG | At 10 kG | At 15 kG | Eddy Current Loss, Watts/lb/Cycle × $10^{-2}$ At 6 kG | At 10 kG | At 15 kG |
|---|---|---|---|---|---|---|---|
| | 125 | 1.26 | 2.87 | 5.65 | 0.25 | 0.69 | 1.65 |

Figure 4:
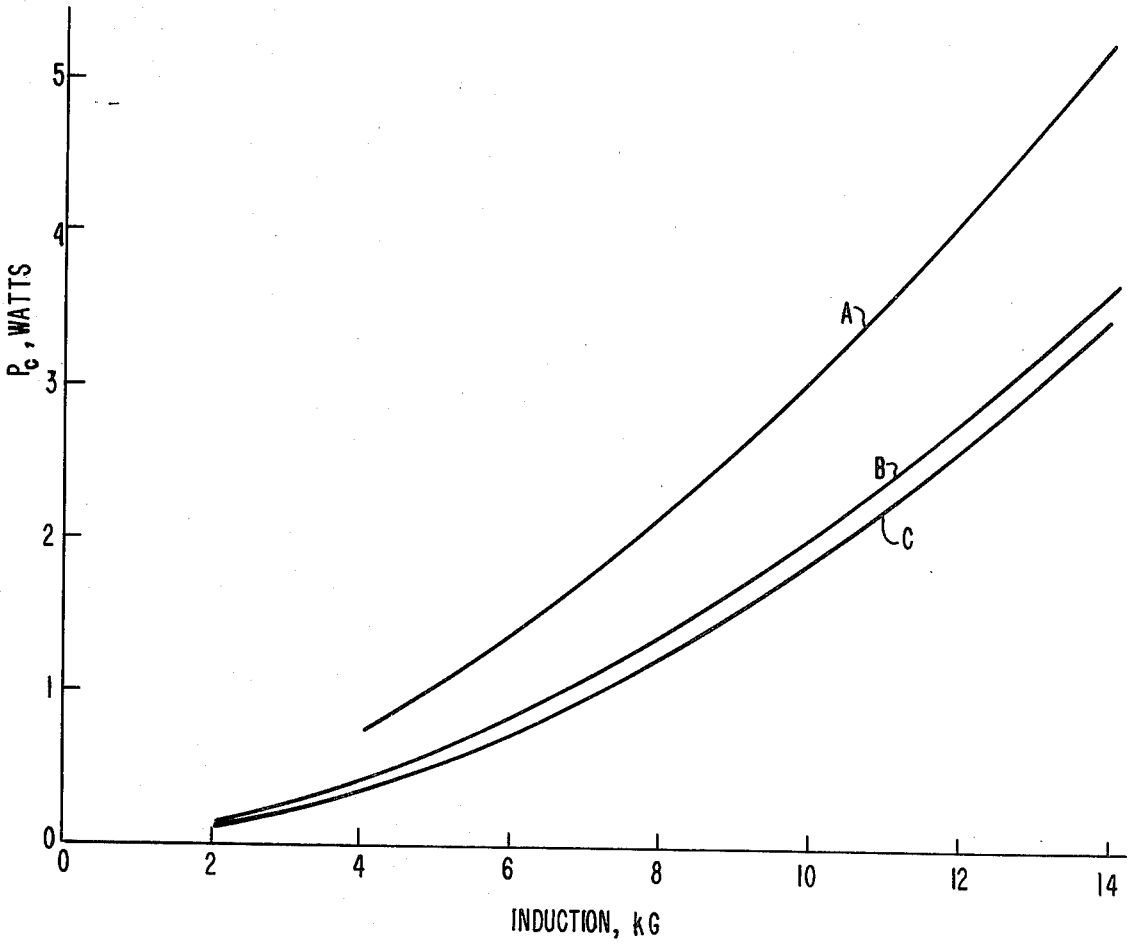
FIG. 4 is a graph showing the effect of repressing on core loss.
Figure 5:
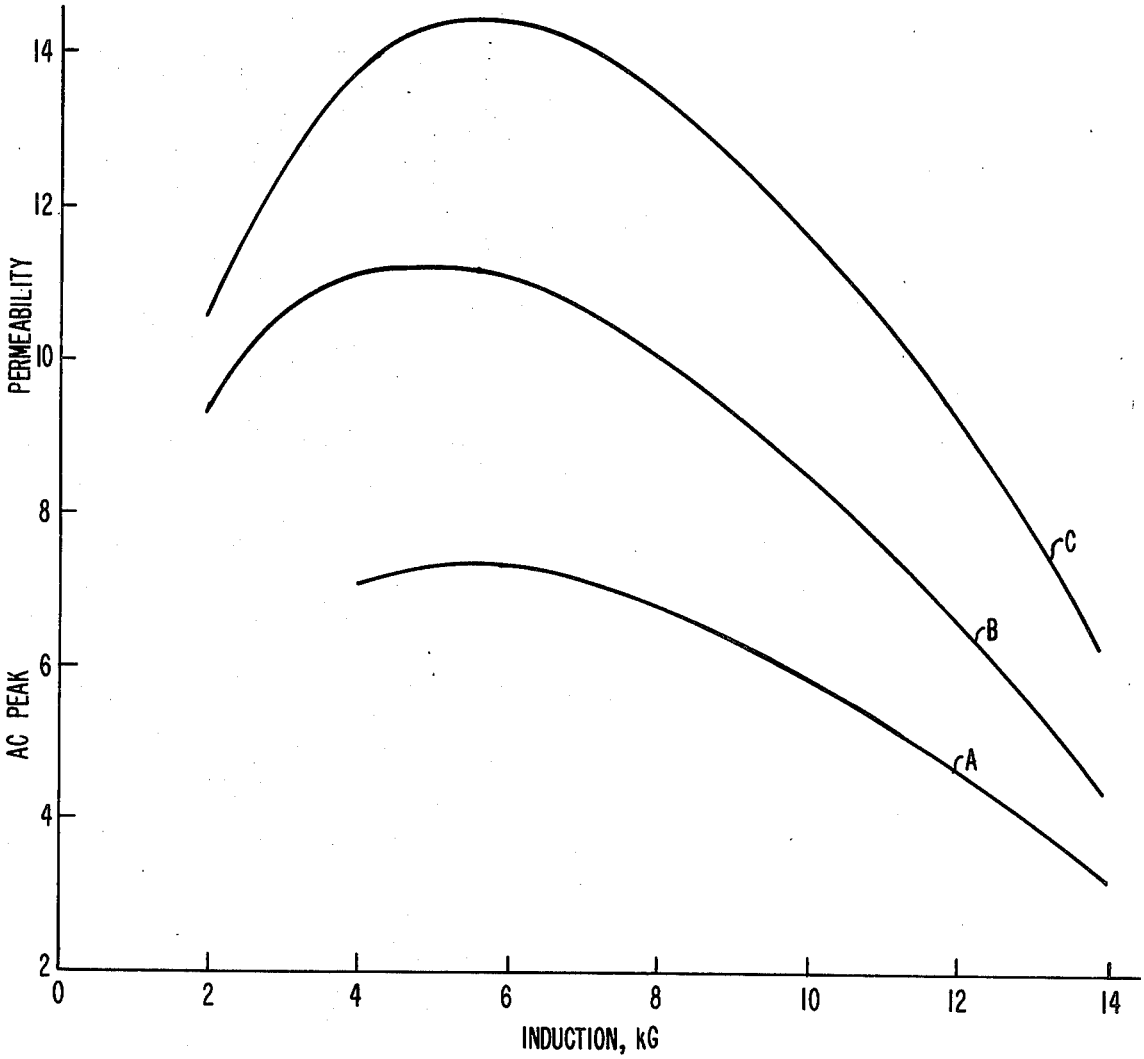
FIG. 5 is a graph showing the effect of repressing of magnetic permeability.

In FIGS. 4 and 5, curves A, B and C are identified as follows: Curve A represents samples which are as-pressed at a pressure of 125,000 psi; Curve B represents samples pressed at 125,000 psi followed by an anneal for 15 minutes at 800° C., and then uniaxially repressed at 125,000 psi; and Curve C represents samples pressed at 125,000 psi; annealed for 15 minutes at 800° C.; and then isostatically repressed at 100,000 psi.

In conclusion, it has been found that the 60 Hz magnetic characteristics are significantly improved by reannealing and repressing. The 14 kG permeability is increased from approximately 300 to 600, while the core loss is reduced from 5.3 to approximately 3.5 W/lb.

What is claimed is:

1. A method of making pressed magnetic core components having improved magnetic characteristics for use in electrical apparatus, comprising the steps of:

(a) forming microlaminations from ferrous alloy stock, (b) annealing said microlaminations in decarburizing and deoxidizing atmosphere to improve the magnetic characteristics and to reduce the carbon to less than 0.01%, (c) coating said microlaminates with electrically insulating material, (d) assembling said microlaminations within a mold of predetermined configuration, (e) compacting said microlaminations into the desired configuration of a magnetic core compact, (f) annealing said core to relieve stresses, and (g) recompacting said magnetizable compact to improve the magnetic characteristics.

2. The method of claim 1 in which the material from which the microlaminations are formed in an iron alloy having a carbon content of from about 0.05% to about 0.15%.

3. The method of claim 1 in which each microlamination has dimensions within the range between about 0.05 and about 0.20 inch in length, from about 0.005 and about 0.05 inch in width, and from about 0.002 and about 0.02 inch in thickness.

4. The method of claim 1 in which the annealing step (b) occurs at a temperature in the range of about 1325° F. an about 1650° F.

5. The method of claim 4 in which the annealing step (b) occurs for a time period of up to 2 hours.

6. The method of claim 1 in which the annealing step (f) occurs at a temperature in the range of from about 1300° F. and about 1800° F. for from about 5 minutes to about 1 hour.

7. The method of claim 1 in which the recompaction step (g) occurs at a pressure in the range of 50,000 to 125,000 psi.

* * * * *